US005606508A

United States Patent [19]

Thiel

[11] Patent Number: 5,606,508

[45] Date of Patent: Feb. 25, 1997

[54] ASSEMBLY FOR FRANKING POSTAL MATTER

[75] Inventor: Wolfgang Thiel, Berlin, Germany

[73] Assignee: Francotyp Postalia GmbH, Berlin, Germany

[21] Appl. No.: 445,355

[22] Filed: May 19, 1995

Related U.S. Application Data

[63] Continuation of Ser. No. 49,679, Apr. 16, 1993, abandoned.

[30] Foreign Application Priority Data

Apr. 16, 1992 [DE] Germany ..... 42 13 278.9

[51] Int. Cl.[6] ..... G07B 17/00

[52] U.S. Cl. ..... 364/464.2; 177/25.15; 364/464.24; 364/464.19

[58] Field of Search ..... 235/375; 177/25.15; 364/464.02, 464.03

[56] References Cited

U.S. PATENT DOCUMENTS

| | | | |
|---|---|---|---|
| 3,635,297 | 1/1972 | Salava . | |
| 4,122,532 | 10/1978 | Dlugos et al. . | |
| 4,138,735 | 2/1979 | Allocca et al. | 364/464.02 |
| 4,251,874 | 2/1981 | Check, Jr. | 364/464.02 |
| 4,471,441 | 9/1984 | Check, Jr. | 364/464.02 |
| 4,506,330 | 3/1985 | Dlugos | 364/466 |
| 4,797,832 | 1/1989 | Axelrod | 235/375 |
| 4,800,504 | 1/1989 | Durst | 235/375 |
| 4,800,505 | 1/1989 | Axelrod | 235/375 |
| 4,800,506 | 1/1989 | Axelrod | 235/375 |
| 4,802,218 | 1/1989 | Wright et al. | 380/23 |
| 4,910,686 | 3/1990 | Chang et al. | 364/464.02 |
| 5,111,030 | 5/1992 | Brasington et al. | 235/375 |
| 5,357,629 | 10/1994 | Dinnis et al. | 395/600 |

FOREIGN PATENT DOCUMENTS

| | | |
|---|---|---|
| 0099666 | 2/1984 | European Pat. Off. . |
| 0373971 | 6/1990 | European Pat. Off. . |
| 0405357 | 11/1994 | European Pat. Off. . |
| 0328059 | 4/1995 | European Pat. Off. . |
| 3903718 | 8/1989 | Germany . |
| 2803982 | 4/1990 | Germany . |
| 2207095 | 1/1989 | United Kingdom . |
| 88/01818 | 3/1988 | WIPO . |

*Primary Examiner*—Edward R. Cosimano

*Attorney, Agent, or Firm*—Herbert L. Lerner; Laurence A. Greenberg

[57] ABSTRACT

A system for franking postal matter comprises a control module, a printer module, a memory connected to the control module, a receiving device connected with the memory for receiving data transmitted via transmission device. At least one table of data with information linked to one or more conditions are downloaded from the transmission device. The control module storing the data in predetermined memory regions of the memory when the assembly is put into operation. A current table of data and information is selected from the data with specific functions to be available in the assembly for franking postal matter in dependence on the one or more conditions.

19 Claims, 3 Drawing Sheets

| | Region A (Country of Origin) | | | | | |
|---|---|---|---|---|---|---|
| | Date for Updating | | | Date for Updating | | |
| WEIGHT in [g] | Zone 1 Class & Type | Zone 2 Class & Type | Zone 3 Class & Type | Zone4 Class & Type | Zone 5 Class & Type | Zone 6 Class & Type |
| | | | | | | |
| | | | | | | |
| | | | | | | |
| | | | | | | |

| | Country of Origin A | | Country of Origin B | |
|---|---|---|---|---|
| | TIME FROM TO | TIME FROM TO | TIME FROM TO | TIME FROM TO |
| Date | F1 F2 | F3 F5 | F2 F4 | F1 F3 |
| Date | | | | |
| | | | | |
| | | | | |
| | | | | |

Fig. 3a

| | Country of Origin A | | Country of Origin B | |
|---|---|---|---|---|
| | Field | Field | Field | Field |
| Date | F1 F3 | F2 | F1 | F2 F3 |
| Date | F5 | F4 | F6 F8 | F5 |

Fig. 3b

| | Region A | | Region B | |
|---|---|---|---|---|
| | Field | Field | Field | Field |
| CONDITION | | | | |
| CONDITION | | | | |

Fig. 3c

| | | |
|---|---|---|
| DATE | COUNTRY OF ORIGIN TIME | |
| | DATE MAILED | |
| | PLACE MAILED | |
| | DESTINATION-ADDRESS | |
| | ZONE | CLASS OF MAIL |
| | | TYPE OF MAIL |
| | | WEIGHT |
| POSTAGE | REMAINDER | |
| FUNCTION | | |
| | LIST | LOGO TYPE |
| | ADDRESS | MESSAGE |
| | CUSTUMER NO. | COLOR etc. |
| ERROR REPORT | | |

ASSEMBLY FOR FRANKING POSTAL MATTER

This application is a continuation of application Ser. No. 08/049,679, filed Apr. 16, 1993, now abandoned.

The invention relates to an assembly for franking postal matter, i.e. for applying postage to mail, which has a printer module and a control module as well as memory means and receiving means communicating with the memory means for data that can be transmitted via a transmission means.

Modern postage meters are equipped with at least one input means, one control module, and one printer module. A portable postage meter has a memory and receiving means, communicating with it, for data that can be transmitted via a transmission means. The amounts of postage used by the postage meter are deducted from an amount that can be loaded via the transmission means. In a preferred embodiment of this invention, those means are in the form of a chip card.

The memory of the postage meter according to the invention has updatable segments for at least one table linked to a certain condition, in particular at least one updated postal rate table, and for information and/or supplementary information linked to at least one condition.

It is usual for these new postage rates to be installed at the customer's place of business by the maintenance service, using a nonvolatile memory component. Besides the considerable expense of the maintenance service, this means above all that because the replacement is generally made after the fact, the postage rate table does not become valid on the correct date and at the correct time.

DESCRIPTION OF THE RELATED ART

U.S. Pat. No. 3,635,297 discloses a mail handling apparatus with automatic rate calculation. An exchangeable read-only memory (ROM) includes a postal rate table from which the amount of postage is calculated when the weight of a parcel or other shipping information is entered. The disadvantage here is the effort involved if the rates in the memory table have to be changed when a new set of rates comes into effect. There is no assurance that the user of the apparatus will have the memory replaced at the right time, i.e. when it is time for updating.

Remote value setting for updating the postal rate table stored in postage meters when a new set of rates comes into effect has already been proposed, for instance in German patent publication DE 28 03 982. From a central data station, the new rates are transmitted simultaneously by remote control to a plurality of postage meters. However, updating the postage meters with the new rates requires that the postage meters be turned on at those times and that they be continuously capable of being addressed.

For security against fraudulent manipulation, German patent publication DE 38 23 719 also discloses the printing out of a representative symbol pattern beyond a certain date. When the mail is checked in the post office, the printed date and the symbol are compared with the pattern authorized for that date. For printing, an authorization device is used that has a memory device for storing a number of data pertaining to the symbol patterns and dates. The data that assign the representative symbol pattern to a defined date are then updated by means of an external selector via a remote value setting whenever the respective user of the postage meter returns for recrediting. However, this security system is limited to fixed networks and cannot be employed with portable postage meters, which can be taken from one place to another (mobile office).

Until now, it has therefore been impossible to update portable postage meters, that is, those postage meters that are not permanently installed via a telephone network, and to secure them against fraudulent manipulation.

SUMMARY OF THE INVENTION

It is accordingly an object of the invention to provide an assembly for franking postal matter, which overcomes the hereinafore-mentioned disadvantages of the heretofore-known devices of this general type and to assure security against fraudulent manipulation of any kind and to provide for the application of postage in accordance with valid postal rates as a function of the inputtable mail weight and format. The object is largely directed at providing a portable postage meter of the generic type referred to above which can be operated regardless of its location.

With the foregoing and other objects in view there is provided, in accordance with the invention, a system or assembly for franking postal matter, comprising a control module and a printer module; memory means having predetermined memory regions connected to the control module, receiving means communicatingly connected with the memory means for receiving data transmitted via transmission means; the receiving means including means for downloading at least one table of data from the transmission means, wherein the table of data contains information linked to at least one condition; the control module having means for storing the at least one table of data received by the receiving means into one of the predetermined memory regions of the memory means when the assembly is put into operation; and the control module including further means for selecting from the at least one table of data a current table of data and information regarding specific functions to be available in the assembly for franking postal matter as a function of the at least one condition.

In accordance with an added feature of the invention, the at least one table of data includes at least one postal rate table; the downloading and storing means, when the assembly is put into operation, loading the at least one postal rate table from the transmission means, via the receiving means, into one of the predetermined memory regions of the memory means; and the control module having further means for selecting an applicable postage from the postal rate table currently in effect, in dependence on a place of origin of the postal matter and on a current date.

In accordance with an additional feature of the invention, the receiving means include means for reading a chip card, and wherein the transmission means is a chip card, the chip card having a memory with predetermined memory regions, the predetermined memory regions including at least one region for storing a postal rate table and an associated date defining a date when the postal rate table comes into effect. In a preferred embodiment, the afore-mentioned at least one region is a plurality of regions, and each region is provided for at least one postal rate table and an associated date.

In accordance with a further feature of the invention, the transmission means is a cellular communications network, and including a memory in the cellular communications network having memory segments; and mobile radio means associated with the receiving means for receiving input from the memory in the cellular communications network of information associated with a geographic origin and with a local time. In a preferred embodiment, the receiving means include means for automatically transferring into the memory means the information received from the cellular communications network, when the mobile radio means is turned on.

In accordance with yet an added feature of the invention, the predetermined memory regions of the memory of the chip card or of the cellular communications network include memory regions for a postal rate, supplementary function tables and supplementary information to be loaded via the receiving means, and the assembly includes input means for allowing operator input of information such as country of origin, place of origin, country and local time.

In accordance with yet an additional feature of the invention, the assembly includes a communications bus connecting the control module to other modules and components, and a battery-powered clock component for supplying the assembly with time and date data via the bus.

In accordance with yet a further feature of the invention, the data transmitted via the transmission means include postal rate tables divided into zones, and input means for inputting a weight of the postal matter, a class of service and a type of mail for each zone of the postal rate tables which can be downloaded into the assembly. In one embodiment the input means allow direct manual input by an operator for ascertaining a postage.

In accordance with again a further feature of the invention, the transmission means include stored data regarding supplementary functions to be downloaded which are valid for only a limited period of time and only for a predetermined geographic location from a previously determined date onward, some of the supplementary functions being freely selectable and some being not manipulatable for security purposes.

In accordance with again an added feature of the invention, the control module, the printer module, the memory means, the receiving means, and, optionally, other features mentioned above, are incorporated in a portable postage meter.

In accordance with again an additional feature of the invention, the assembly includes a communications bus connecting the control module to other modules and components, and a programmable clock component for supplying the assembly with an applicable local time when a certain location is specified.

In accordance with a concomitant feature of the invention, the input means include a scales for weighing the postal matter which, in a preferred embodiment, are in the form of an integrated weighing module.

The invention is based on the fact that the transmission at the proper time of the new postal rates to all the postage meters, in particular to portable postage meters that have not been turned on in the meantime or are not ready to run, has not occurred, so that the rates are intermediately stored in a transmission means and the current set of rates is automatically adopted by the postage meters when they are turned on.

The invention is also based on the concept of planning for setting up postal rate tables early when a change in postal rates is expected, so that the rates can be made accessible to all the postal service customers long before they come into effect. The intent is for the majority of subscribers to be equipped with an updated postal rate table in good time, rather than on the very day and simultaneously as before.

Also in good time, when the postage meter is put into operation or turned on, a table with supplementary functions for security or for error checking and checking for fraudulent manipulation and for increasing the ease of use is loaded.

Other features which are considered as characteristic for the invention are set forth in the appended claims.

Although the invention is illustrated and described herein as embodied in an assembly for franking postal matter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 3*a*–3*c* are maps for supplementary function table memory regions;

DESCRIPTION OF THE PREFERRED EMBODIMENTS

Figures 1, 2:
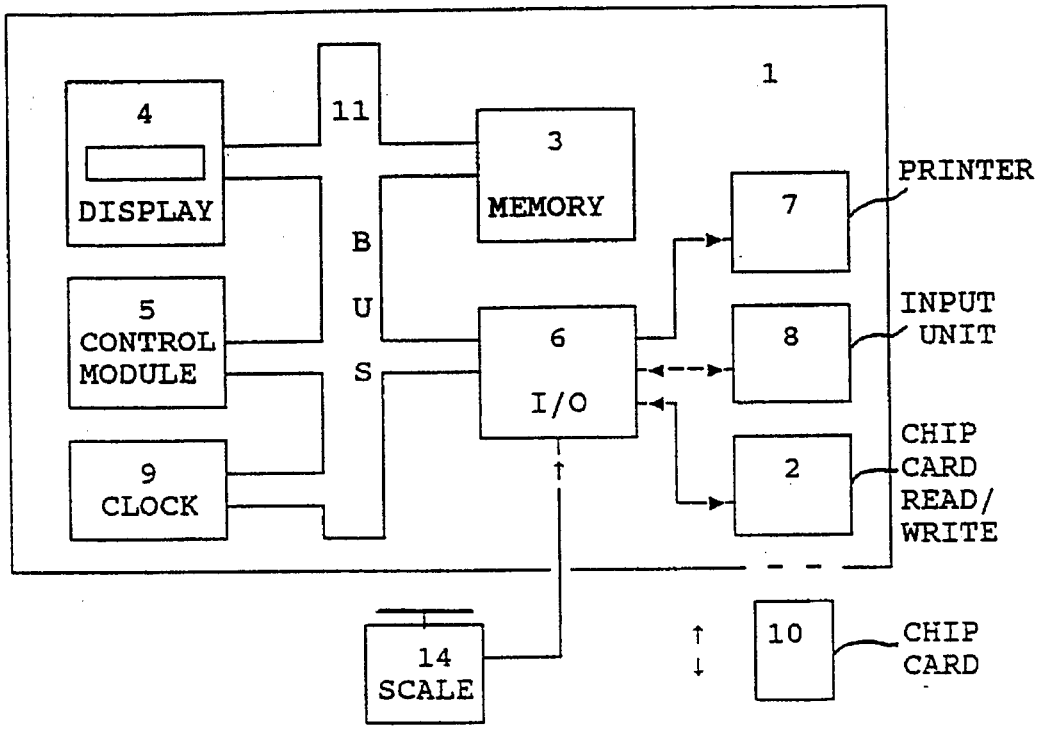
FIG. 1 is a block diagram of the postage meter assembly according to the invention.
FIG. 2 is a map of postal rate table memory regions.

Referring now to the figures of the drawing in detail and first, particularly, to FIG. 1 thereof, there is seen a chip card 10, or smart card, of the kind already known for setting the value on debit or charge accounts and the like. In that embodiment, the chip card 10 is used as the transmission means and has a current postal rate table, plus an additional postal rate table that is valid for the rates to come. The block diagram of FIG. 1 includes a postage meter 1 according to the invention with a chip card read/write unit 2. A memory means 3 is connected to a display means 4. A bus 11 interconnects the components, as for instance the memory means to a control module 5 and to an input/output means 6. A printer module 7, an input means 8 and the chip card read/write unit 2 are connected to the input/output unit 6. A terminal of a weighing module 14 is also provided either directly via the buss 11 or via the input/output means 6.

It is presumed, in this context, that a programmable battery-operated clock component 9 is present in each postage meter, the programming accuracy of which is such that it provides the correct data pertaining to the date, so that the current date data and the future data for the date when the associated postal rate tables come into effect can be loaded into the memory means 3 of the postage meter. The programming pertains in particular to the locally variable time to be taken into account, to time zones that are substantially dependent on the longitude, and to the dateline to be taken into account.

This is advantageous not only for a postage meter configuration that is operated only in a stationary way but also for a portable postage meter that can be taken from place to place, because the postage meter configuration includes a programmable clock component 9 that furnishes the applicable local time or postage metering time including the date, based on a defined actual or a future specified place. For a given clock accuracy, which need not be checked until after a very long period of time, it may suffice to set the clock merely once, at the factory, as long as the local time is adjustable by entering the current geographic location. To that end, one memory region is provided for the clock component and contains the relevant places with the associated time difference for a place so the clock can be set. The time difference is in the form of additions to and subtractions from Greenwich Mean Time.

The postage meter 1 has means in the control module 5 that, when the postage meter 1 is put into operation, load at least one postal rate table for the postage meter 1 from the chip card 10 via the receiving means 2 and 6 into a predetermined memory space of the memory means 3. The postage meter also includes other means in the control module 5, which by way of the means 3, 4, 8, 9 and 11, based on the country or place of origin entered and on the date, select the current postal rate table in effect at the time, from which the applicable postage is then ascertained. By hardware and/or software, these means are manufactured in the form of a fixedly or freely programmable logic module or program of a microprocessor control.

The chip card 10 is intended for use as a debit card with national or international validity, although this should in no way preclude other means of processing monetary data. In a preferred embodiment the chip card has validity for the European Community. Adaptations to various North American systems are well within the skill of the ordinary artisan. The charges are paid and accounted for by some central servicing office for the national postal systems, for instance.

Advantageously, further functions are stored in the chip card 10 in such a way that they can be called up, by means of the current date furnished by the clock component 9. The information for the further functions to be loaded into the postage meter is linked to a specific condition (e.g. date, time, place).

Security against fraudulent manipulation can be increased by providing that upon updating, a number of functions associated with the updated date are loaded into the postage meter 1, From that, the further functions to be loaded and that can be tripped are specified in versatile and nonelective form. For security against fraudulent manipulation, the national postal system to which the particular place of mail origination belongs can specify an expression that is machine-readable only by that national postal service. This expression may for instance be the transaction number for authorization checking, shown as a bar code, or some other symbol agreed upon by convention, which is printed on the mail at a defined point using the same printer or a different printer.

In order to provide a broader selection among the functions loaded into the postage meter, it is also possible to provide for entering the place of origin, the location of the mailbox or of the applicable post office, and/or the applicable postal system, and the like, using the input means 8.

FIG. 2 shows a memory region having a memory segment assigned to an updating date for the current postal rate table and the future postal rate table. In this way at least one postal rate table is available, as a function of the memory region associated with a country of origin. This makes the correct setting of the rates for each machine possible by means of the information stored in memory in the transmission means.

Every postal rate table for a national postal system is divided into zones for sending mail from the place of origin, in other words the post office to which the mailbox where the mail is dropped off is assigned, to the receiving location to which the mail to which postage is to be applied will be sent. The zones, which are associated with distances and/or assigned to domestic vs. foreign locations, or the distance from the place of origin to the receiving location may be stored in memory as a supplementary function in such a way that it can be called up and ascertained in a further memory region A, B, C, etc., for each country, and the appropriate zone in the current table is addressed by the control means (FIGS. 3*a*–3*c*). Once the correct zone has been determined, the postal customer can make a selection from among the services agreed upon among the various national postal systems and the postage machine manufacturer, in terms of class of mail (letter, reply postcard, printed matter, second-class letter, parcel, etc.), the type of shipment (declaration of value, registered, mailing by a private individual, return receipt requested, C.O.D., express mail, air mail, priority mail, general delivery, etc.), and additional services (prepayment) or similar imprints (logo, advertising, etc.).

Once the weight and the type of mail and shipment form of the mail have been entered, the postage corresponding to the zones can be found automatically. Other postal rate tables (not shown in FIG. 2 but valid as of the current further updating date) for further postal systems, and preferably for each of the national postal systems, are stored in memory regions. For each table, the date (which is to be entered) of the date stamp that appears on the mail should be compared with the updating date, i.e., the date when the table comes into effect; the control means performs this comparison.

In FIGS. 3*a*–3*c*, the supplementary function tables are shown that are stored in the further memory regions and each correspond to a country of origin A, B or place of origin and/or a date. By inputting the country of origin A, B for each region, a first selection among the functions to be loaded into the postage meter is made manually or automatically and loaded into its memory means when the postage meter is put into operation. The supplementary functions F1 (payment for express mail from 6 am to 10 pm), F2 (payment for express mail from 10 pm to 6 am), F3 (payment for mailing by an individual), Fn (etc.), and so forth are valid for an agreed upon time of day or for a limited period of time determined by the particular national postal system (FIG. 3*a*).

FIG. 3*b* pertains to a table for a number of supplementary functions which are to be transmitted to the postage meter and afterward are freely selectable. As a rule, in stationary operation of a postage meter, the mail is picked up. It is also possible for an in-house stationary mailbox to be agreed upon with the post office. For mobile use of a postage meter, other services by the postal systems (assigning a zip code and numbers of post offices for place names) must necessarily be used. The data for mailboxes in public places, such as harbors, airports, railroad stations, locations of increased traffic and other node points, which are open all the time and serve as drop-off and acceptance points for mail, are listed in a further, non-illustrated updatable directory, and are suitable for calling up stored information or making functions available by way which these data for open acceptance points and the date are manually input in a field. A further memory region is provided for that purpose. If a number of functions cannot be selected for local reasons, then a different place of origin that allows these functions can be ascertained.

An agreement may also be made between the customer and the manufacturer that certain additional information be printed at some other point on the mail, in particular calendar information and temporary advertising messages. For instance, an exhibitor can advertise a trade fair. This information to be printed appears automatically in the printed image in accordance with the prior programming. A further memory region may be provided for that purpose as well.

FIG. 3*c* relates to a table for the supplementary functions that are firmly agreed upon and are to be transmitted to the postage meter if a given condition is met. The supplementary functions that produce an additional identifying marking serve for example to provide security in recognizing predating for future mail, or in other words where the mail has postage applied in advance. Such functions are agreed upon between the postage meter manufacturer and the postal system and are defined by the time the mail is taken to the place where it is mailed.

A further selection from among the functions to be loaded into the postage meter is automatically made and loaded into the storage means of the postage meter when it is placed into operation (FIGS. 3*b* and 3*c*, respectively), by inputting a field to indicate where the mail is mailed, the location of the mailbox, and in particular the zip code (ZIP) or the number of the post office responsible.

Figures 4, 5:
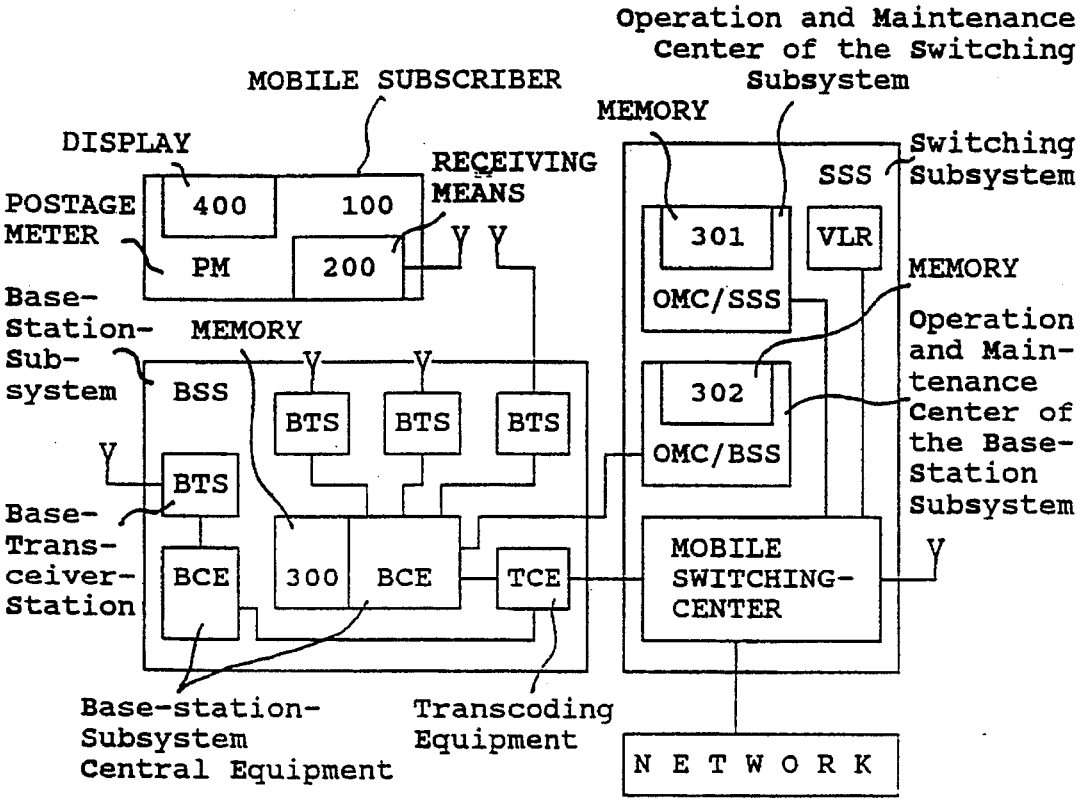
FIG. 4 is a diagram of a GSM communication variant.
FIG. 5 is a view of an information field.

In a further variant—shown in FIG. 4—of the embodiment according to the invention, cellular communications networks, in particular Groupe Speciale Mobile (GSM) networks, are used as transmission means. Such GSM networks have a radio-type mobile switching subsystem (SSS), with connections on the one hand to other radio or stationary networks (NETZ), in particular PSTN, ISDN and PDN, and on the other to mobile subscribers 100, i.e. postage meter with receiving means 200 via a radio-operated base station subsystem (BSS). In the BSS, transcoding equipment (TCE) is connected to a plurality of BSS central equipment (BCE), to which the various base-transceiver stations (BTS) are connected. Central operation and maintenance centers of the mobile switching center system (OMC/SSS), or such offices (OMC/BSS) of the base station system (BSS), or the associated control device (BCE) are equipped with a memory means (300, 301 or 302), which has memory segments for the published postal rate tables that can be called up and the non-secret supplementary function tables and for other service and supplementary information.

For portable postage meters, entering the country or place of origin and the country or local time can preferably be done automatically. In Europe, for instance, this is implemented by using the Digital European Cordless Telephone network (DECT).

An information field—shown in FIG. 5—for the date, place of origin, weight, format, postage amount, and other typical indications, and for the supplementary functions permitted by the applicable national postal system may be displayed in the display means 4 or 400 of the applicable postage meter 1 or 100, in order to make a selection of functions. Not displayed is the information that can be called up only by means of a password, such as the serial number of the postage meter, the transaction number, the piece count, the registry amount, the postage sum; and a debit schedule of the amounts deducted.

The foregoing is a description corresponding in substance to German Application P 42 13 278.9, dated Apr. 16, 1992, the International priority of which is being claimed for the instant application, and which is hereby made part of this application. Any material discrepancies between the foregoing specification and the aforementioned corresponding German application are to be resolved in favor of the latter.

I claim:

1. An assembly for franking postal matter, comprising:

a control module and a printer module;

internal memory means having predetermined memory regions connected to said control module, receiving means communicatingly connected with said internal memory means for receiving complete rate tables transmitted via transmission means;

said receiving means including means for downloading at least one table of data from the transmission means, wherein the table of data contains information linked to at least one condition;

said control module having means for storing the at least one table of data received by said receiving means into one of said predetermined memory regions of said internal memory means when the assembly is put into operation;

said control module including further means for selecting from the at least one table of data a suitable table of data satisfying the at least one condition; and wherein the at least one table of data includes at least one postal rate table; said downloading and storing means, when the assembly is put into operation, loading the at least one postal rate table from the transmission means, via the receiving means, into one of said predetermined memory regions of said internal memory means; and said control module having further means for reading, from the table stored in said memory regions of said internal memory means, an applicable postage from the postal rate table.

2. The assembly according to claim 1, including a communication bus connecting said control module to other modules and components, and a battery-powered clock component for supplying the assembly with time and date data via said bus.

3. The assembly according to claim 1, including a communications bus connecting said control module to other modules and components, and a programmable clock component for supplying the assembly with an applicable local time on the basis of a specified location.

4. The assembly according to claim 1, wherein said receiving means include means for reading a chip card, and wherein the transmission means is a chip card, said chip card having a memory with predetermined memory regions, said predetermined memory regions including at least one region for storing a postal rate table and an associated date defining a date when the postal rate table comes into effect.

5. The assembly according to claim 4, wherein said at least one region is a plurality of regions, each region being provided for at least one postal rate table and an associated date.

6. The assembly according to claim 4, wherein said predetermined memory regions of said memory of said chip card include memory regions for a postal rate, supplementary function tables and supplementary information to be loaded via said receiving means, and including input means for allowing operator input of information selected from country of origin, place of origin, country and local time.

7. The assembly according to claim 1, wherein the data transmitted via the transmission means include postal rate tables being divided into zones, and including input means for inputting a weight of the postal matter, a class of service and a type of mail for each zone of the postal rate tables which can be downloaded into the assembly.

8. The assembly according to claim 7, wherein said input means allow direct manual input by an operator for ascertaining a postage.

9. The assembly according to claim 7, wherein said input means allow automatic input for ascertaining a postage.

10. The assembly according to claim 7, wherein said input means include a scales for weighing the postal matter.

11. The assembly according to claim 10, wherein said scales are in the form of an integrated weighing module.

12. An assembly for franking postal matter, comprising:

a control module and a printer module;

memory means having predetermined memory regions connected to said control module, receiving means communicatingly connected with said memory means for receiving data transmitted via a cellular communications network;

said receiving means including means for downloading at least one table of data from the transmission means, wherein the table of data contains information linked to at least one condition;

said control module having means for storing the at least one table of data received by said receiving means into one of said predetermined memory regions of said memory means when the assembly is put into operation; and said control module including further means for selecting from the at least one table of data a current table of data and information regarding specific functions to be available in the assembly for franking postal matter as a function of the at least one condition, and including a memory in the cellular communications network having memory segments; and mobile radio means associated with said receiving means for receiving input from the memory in the cellular communications network of information associated with a geographic origin and with a local time.

13. The assembly according to claim 12, wherein said receiving means includes means for automatically transferring into said memory means the information received from the cellular communications network, when said mobile radio means is turned on.

14. The assembly according to claim 12, wherein the memory segments of the memory of the cellular communications network include memory segments for the postal rate, supplementary function tables and supplementary information to be loaded via said receiving means, and including input means for allowing input of information selected from country of origin, place of origin, country and local time, when the assembly is switched on.

15. The assembly according to claim 12, wherein said control module, said printer module, said memory means and said receiving means are incorporated in a portable postage meter.

16. An assembly for franking postal matter, comprising:

a control module and a printer module;

memory means having predetermined memory regions connected to said control module, receiving means communicatingly connected with said memory means for receiving data transmitted via transmission means;

said receiving means including means for downloading at least one table of data from the transmission means, wherein the table of data contains information linked to at least one condition;

said control module having means for storing the at least one table of data received by said receiving means into one of said predetermined memory regions of said memory means when the assembly is put into operation; and said control module including further means for selecting from the at least one table of data a current table of data and information regarding specific functions to be available in the assembly for franking postal matter as a function of the at least one condition, wherein the transmission means include stored data regarding supplementary functions to be downloaded which are valid for only a limited period of time and only for a predetermined geographic location from a previously determined date onward, some of the supplementary functions being freely selectable and some being not manipulatable for security purposes.

17. A method of franking postal matter with an assembly for franking postal matter, wherein the assembly comprises a control module and a printer module; memory means having predetermined memory regions connected to the control module, receiving means communicatingly connected with the memory means for receiving data transmitted via transmission means;

the method which comprises:

downloading, with the receiving means, at least one table of data from the transmission means, and linking information contained in the table of data to at least one condition;

putting the assembly into operation and immediately storing, with the control module, the at least one table of data received by the receiving means into one of the predetermined memory regions of the memory means; and subsequently selecting, with the control module, from the at least one table of data a current table of data and information regarding specific functions to be available in the assembly for franking postal matter as a function of the at least one condition.

18. The method according to claim 17, wherein the receiving means include means for reading a chip card and the transmission means is a chip card, and wherein the method further comprises inserting a chip card into the chip card reading means for downloading with the receiving means, and removing the chip card prior to franking postal matter with the assembly.

19. An assembly for franking postal matter, comprising:

a control module and a printer module;

memory means having predetermined memory regions connected to said control module, receiving means communicatingly connected with said memory means for receiving data transmitted via transmission means;

said receiving means including means for downloading at least one table of data from the transmission means, wherein the table of data contains information linked to at least one condition;

said control module having means for storing the at least one table of data received by said receiving means into one of said predetermined memory regions of said memory means when the assembly is put into operation;

said control module including further means for selecting from the at least one table of data a current table of data and information regarding specific functions to be available in the assembly for franking postal matter as a function of the at least one condition;

a communication bus connecting said control module to other modules and components, and a battery-powered clock component for supplying the assembly with time and date data via said bus; said transmission means including stored data regarding supplementary functions to be downloaded which are valid for only a limited period of time and only for a predetermined geographic location from a previously determined date onward, some of the supplementary functions being freely selectable and some being not manipulatable for security purposes.

* * * * *